US008424144B2

(12) United States Patent
Nanda

(10) Patent No.: US 8,424,144 B2
(45) Date of Patent: Apr. 23, 2013

(54) ILLUMINATED FLASHING TOOTHBRUSH AND METHOD OF USE

(75) Inventor: Puneet Nanda, Cerritos, CA (US)

(73) Assignee: Dr. Fresh, LLC, Buena Park, CA (US)

( * ) Notice: Subject to any disclaimer, the term of this patent is extended or adjusted under 35 U.S.C. 154(b) by 0 days.

(21) Appl. No.: 13/105,637

(22) Filed: May 11, 2011

(65) Prior Publication Data

US 2011/0232012 A1 Sep. 29, 2011

Related U.S. Application Data

(63) Continuation-in-part of application No. 11/734,732, filed on Apr. 12, 2007, now Pat. No. 8,006, 342.

(60) Provisional application No. 61/381,856, filed on Sep. 10, 2010.

(51) Int. Cl.
*A46B 9/04* (2006.01)

(52) U.S. Cl.
USPC ..... 15/22.1; 15/105; 15/167.1

(58) Field of Classification Search ..... 15/105, 15/22.1, 167.1; 463/263; 362/157
See application file for complete search history.

(56) References Cited

U.S. PATENT DOCUMENTS

| | | | |
|---|---|---|---|
| 3,019,572 | A | 2/1962 | Berry et al. |
| 3,324,997 | A | 6/1967 | Bonanno |
| 3,884,635 | A | 5/1975 | Sloan |
| 4,154,997 | A | 5/1979 | Grebner et al. |
| 4,214,657 | A | 7/1980 | Winston |
| 4,476,604 | A | 10/1984 | White et al. |
| 4,779,173 | A | 10/1988 | Carr et al. |
| 4,788,734 | A | 12/1988 | Bauer |
| 4,866,807 | A | 9/1989 | Kreit et al. |
| 5,000,376 | A | 3/1991 | Wojdyla |
| D317,718 | S | 6/1991 | Carol |
| 5,030,090 | A | 7/1991 | Maeda et al. |
| 5,044,037 | A | 9/1991 | Brown |
| 5,068,939 | A | 12/1991 | Holland |

(Continued)

FOREIGN PATENT DOCUMENTS

| | | |
|---|---|---|
| CN | ZL 03266969.0 | 8/2004 |
| DE | 004029770 | 3/1992 |

(Continued)

OTHER PUBLICATIONS

International Search Report and Written Opinion for International Application No. PCT/US2008/060121 mailed Jun. 23, 2008.

(Continued)

*Primary Examiner* — Monica Carter
*Assistant Examiner* — Michael Jennings
(74) *Attorney, Agent, or Firm* — Snell & Wilmer LLP

(57) ABSTRACT

A toothbrush can include a handle and a head. At least one bristle can be attached to the head. The toothbrush can also have an illumination member, an illumination circuit and an activation device. The activation device can include two contact members fixed in a non-contact position on an outside of the handle. A method can include causing conduction between the contact members to activate the illumination circuit. The toothbrush can be an electric toothbrush. The electric toothbrush can have an illumination member positioned such that light from the illumination member can be seen by a user in a mirror facing the user.

17 Claims, 11 Drawing Sheets

U.S. PATENT DOCUMENTS

| | | | | |
|---|---|---|---|---|
| 5,160,194 | A | 11/1992 | Feldman | |
| 5,259,086 | A | 11/1993 | Fong | |
| 5,339,479 | A | 8/1994 | Lyman | |
| 5,382,107 | A | 1/1995 | Nian | |
| 5,438,726 | A | 8/1995 | Leite | |
| 5,485,646 | A | 1/1996 | Merritt | |
| 5,561,881 | A | 10/1996 | Klinger et al. | |
| 5,572,762 | A | 11/1996 | Scheiner | |
| 5,625,916 | A | 5/1997 | McDougall | |
| 5,784,743 | A | 7/1998 | Shek | |
| 5,801,637 | A | 9/1998 | Lomholt | |
| 5,960,507 | A | 10/1999 | Dutra et al. | |
| 6,026,828 | A | 2/2000 | Altshuler | |
| 6,029,303 | A | 2/2000 | Dewan | |
| 6,029,304 | A * | 2/2000 | Hulke et al. | 15/105 |
| 6,106,294 | A | 8/2000 | Daniel | |
| 6,154,912 | A * | 12/2000 | Li | 15/105 |
| 6,178,579 | B1 | 1/2001 | Blaustein et al. | |
| 6,189,693 | B1 | 2/2001 | Blaustein et al. | |
| 6,202,242 | B1 | 3/2001 | Salmon et al. | |
| 6,202,245 | B1 | 3/2001 | Khodadadi | |
| 6,332,233 | B1 * | 12/2001 | Proulx | 15/167.1 |
| 6,360,395 | B2 | 3/2002 | Blaustein et al. | |
| 6,389,633 | B1 | 5/2002 | Rosen | |
| D458,454 | S | 6/2002 | Nanda | |
| D458,758 | S | 6/2002 | Nanda | |
| 6,437,267 | B1 | 8/2002 | Imai | |
| 6,536,068 | B1 | 3/2003 | Yang et al. | |
| 6,606,755 | B1 | 8/2003 | Robinson et al. | |
| 6,611,780 | B2 | 8/2003 | Lundell et al. | |
| 6,623,272 | B2 | 9/2003 | Clemans | |
| 6,725,490 | B2 | 4/2004 | Blaustein et al. | |
| D490,247 | S | 5/2004 | Nanda | |
| 6,735,802 | B1 | 5/2004 | Lundell et al. | |
| D492,116 | S | 6/2004 | Nanda | |
| D505,015 | S | 5/2005 | Nanda | |
| 6,895,625 | B2 * | 5/2005 | Lev et al. | 15/28 |
| D508,399 | S | 8/2005 | Nanda | |
| 6,954,961 | B2 | 10/2005 | Ferber et al. | |
| 7,013,522 | B2 | 3/2006 | Kumagai | |
| 7,109,431 | B2 | 9/2006 | Yanai et al. | |
| 7,201,172 | B2 | 4/2007 | Nanda | |
| 7,596,827 | B1 | 10/2009 | Puneet | |
| 7,718,906 | B2 | 5/2010 | Au et al. | |
| 7,845,039 | B2 * | 12/2010 | Chan et al. | 15/22.1 |
| 7,845,041 | B2 * | 12/2010 | Gatzemeyer et al. | 15/105 |
| 2003/0140437 | A1 | 7/2003 | Eliav et al. | |
| 2003/0205492 | A1 | 11/2003 | Ferber et al. | |
| 2003/0221267 | A1 * | 12/2003 | Chan | 15/22.1 |
| 2004/0057233 | A1 | 3/2004 | Sharrah et al. | |
| 2004/0143920 | A1 * | 7/2004 | Nanda | 15/105 |
| 2004/0168272 | A1 | 9/2004 | Prineppi | |
| 2005/0150067 | A1 | 7/2005 | Cobabe et al. | |
| 2006/0037158 | A1 * | 2/2006 | Foley et al. | 15/105 |
| 2006/0174431 | A1 | 8/2006 | Nanda | |
| 2007/0039109 | A1 | 2/2007 | Nanda | |
| 2007/0074359 | A1 | 4/2007 | O'Lynn | |
| 2007/0131241 | A1 | 6/2007 | Nanda | |
| 2007/0261185 | A1 | 11/2007 | Guney et al. | |
| 2007/0271760 | A1 | 11/2007 | Nanda | |
| 2008/0028553 | A1 | 2/2008 | Batthauer | |
| 2008/0250591 | A1 | 10/2008 | Nanda | |
| 2008/0256730 | A1 | 10/2008 | Chen | |
| 2008/0276398 | A1 | 11/2008 | Nanda | |
| 2009/0070947 | A1 | 3/2009 | Baertschi et al. | |
| 2009/0119861 | A1 | 5/2009 | Nanda | |
| 2009/0144919 | A1 | 6/2009 | Nanda | |
| 2009/0144920 | A1 | 6/2009 | Nanda | |
| 2010/0106336 | A1 | 4/2010 | Hwang et al. | |

FOREIGN PATENT DOCUMENTS

| | | | |
|---|---|---|---|
| DE | 19811676 | | 9/1999 |
| FR | 2680086 | | 2/1993 |
| FR | 2724297 | | 3/1996 |
| FR | 2756471 | | 6/1998 |
| JP | 64-8914 | | 1/1989 |
| JP | 2004-222839 | A | 8/2004 |
| JP | 2006-42966 | A | 2/2006 |
| KR | 10-2004-0052897 | A | 6/1994 |
| KR | 10-0476657 | B1 | 3/2005 |
| WO | WO 00/20185 | | 4/2000 |

OTHER PUBLICATIONS

International Search Report and Written Opinion for International Application No. PCT/US2008/082886 mailed Jan. 23, 2009.

International Search Report and Written Opinion for International Application No. PCT/US2011/038760, Notification mailed Feb. 24, 2012.

* cited by examiner

ILLUMINATED FLASHING TOOTHBRUSH AND METHOD OF USE

PRIORITY INFORMATION

This application is a continuation-in-part of application Ser. No. 11/734,732, filed Apr. 12, 2007. This application also claims priority to provisional application No. 61/381,856, filed Sep. 10, 2010. The entirety of each of the above applications is herein incorporated by reference.

BACKGROUND OF THE INVENTION

1. Field of the Invention

The present inventions relate to dental hygiene and, more particularly, to toothbrushes.

2. Description of the Related Art

To ensure proper oral care, dentists recommend that we brush our teeth more than once a day for at least two to three minutes each time. Despite this recommendation, the average adult person does not brush his or her teeth for two to three minutes. This problem is worse with children, who have notoriously short attention spans and often view brushing their teeth as a chore. Accordingly, there is a general need for a device that encourages people, especially children, to brush their teeth more often and for longer periods of time. See e.g., U.S. Patent Publication No. 2004-0143920, filed Jan. 24, 2003 and published on Jul. 29, 2004, the entirety of which is hereby incorporated by reference herein.

SUMMARY OF THE INVENTION

U.S. Patent Publication No. 2004-0143920 describes a toothbrush with a handle having a base, a body, and a head. The body can have a first section and a second section forming an oblique angle. A projector of a beam of light is located within the handle. The toothbrush can have at least one bristle attached to the head. The toothbrush can have a grip attached to the base. An illumination circuit can be positioned within the handle and is operated by pressing an end of the handle. Pressing the end of the handle can compress a spring which completes the illumination circuit, activating the projector of a light beam within the toothbrush. Applicant has recognized that some children may have trouble activating the illumination circuit. Accordingly, a need exists for an improved activation mechanism, among other things.

According to some embodiments, a toothbrush can comprise a handle having a first end and a second end, a head coupled to the first end of the handle and an illumination element within the handle. The head can include a plurality of bristles. The toothbrush can further include a power source connected to the illumination element, an activation device and a timing circuit. The activation device can have a first contact terminal on an outside surface of the handle and a second contact terminal on the outside surface of the handle. The first and second contact terminals can be in fixed relative non-contact positions. The timing circuit can be configured such that presence of a liquid completes a circuit between the first contact terminal and the second contact terminal and activates the timing circuit for a set period of time. Further, the illumination element can be activated during all, part of, and/or at the end of, the set period of time.

In some embodiments, the timing circuit can be configured such that contact with liquid at the activation device after the initial activation, will not reactivate the timing circuit until the timing circuit has completed a cycle. Also, the activation device may further include a base, wherein the first and second contact members are positioned within the base.

According to some embodiments, a toothbrush can include a handle having a first end and a second end, a head with a plurality of bristles coupled to the first end of the handle, an illumination circuit, and an illumination member configured to be activated by the illumination circuit. In some embodiments, the toothbrush can further include a power source coupled to the illumination member, and a sensor on an outside surface of the handle. The circuit can start a timed cycle upon receiving a signal from the sensor. In some embodiments, the sensor can have two contact terminals fixed relative to one another in a non-contact position. The contact terminals can activate the circuit when electrical conduction occurs between the terminals.

In some embodiments, conduction can occur in various ways including contact between the sensor and liquid or human skin. For example, the sensor can be configured to detect the presence of a liquid. The presence of the liquid can complete a circuit between the two contact terminals to thereby activate the illumination circuit, wherein the illumination element is activated during all, part of, and/or at the end of, the timed cycle. As another example, the illumination circuit and contact terminals can be configured to allow contact with human skin to both terminals to cause conduction to occur, thereby activating the illumination circuit.

A method can include providing a toothbrush including an illumination circuit and activating the illumination circuit. The toothbrush can further including one or more of a handle having a first end and a second end, a head at the first end of the handle, the head comprising a plurality of bristles, an illumination member, a power source coupled to the illumination member, and an activation device. In some embodiments, the activation device can comprise two contact terminals on an outside surface of the handle, the two contact terminals being located in fixed relative positions to one another. In some embodiments, the step of activating can include activating the illumination circuit by electrical conduction between the two contact terminals, wherein the circuit starts a timed cycle upon receiving a signal from the activation device, wherein the illumination member is activated during all, part of, and/or at the end of, the timed cycle.

In some embodiments of a method, activating the illumination circuit can further comprise blinking the illumination member during the timed cycle. Activating the illumination circuit may include contacting both terminals with human skin to cause conduction to occur, thereby activating the circuit. Activating the illumination circuit may include contacting both terminals with water to cause conduction to occur, thereby activating the circuit.

According to some embodiments a toothbrush can comprise an electric toothbrush. The electric toothbrush can include a handle having a first end, a second end and an internal chamber. The electric toothbrush may also have a head coupled to the first end of the handle and a grip at the second end. The head can have a plurality of bristles. The electric toothbrush can further include a window positioned between the head and the grip and on a side of the electric toothbrush opposite the bristles, an illumination element within the internal chamber and configured such that light from the illumination element is visible through the window, a motor within the internal chamber and configured to impart motion to at least one of the plurality of bristles, a timing circuit configured to activate for a set period of time, wherein the illumination element is activated during all, part of, and/or at the end of, the set period of time, and an activation device configured to activate the motor and the timing circuit. The electric toothbrush can be configured so that, when in use brushing teeth, the user can see light from the illumination element in a mirror facing the user.

In some embodiments, the motor can be configured to be on during the set period of time and to be automatically turned off after the set period of time. In some embodiments, the activation device can be configured to turn off the illumination element and the motor, whether or not the set period of time has been completed.

DETAILED DESCRIPTION OF THE PREFERRED EMBODIMENTS

Figure 1:
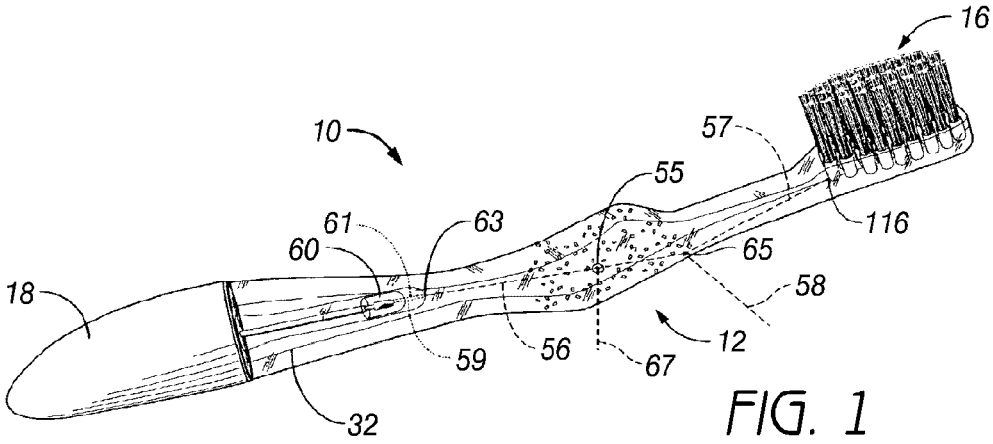
FIG. 1 (PRIOR ART)
FIG. 1 is a perspective view of a prior art toothbrush.
Figure 2:
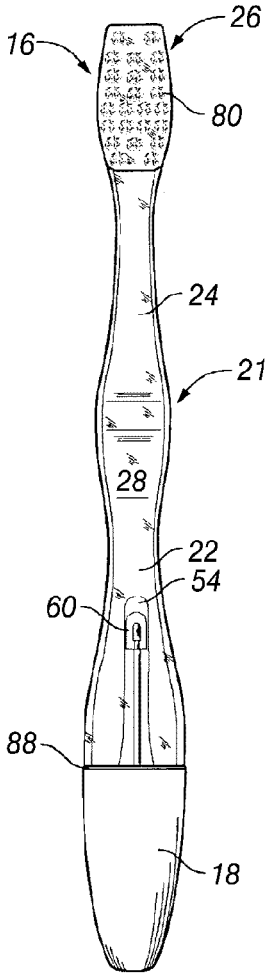
FIG. 2 (PRIOR ART)
FIG. 2 is a front elevation view of the toothbrush of FIG. 1 showing the brush side of the toothbrush.
Figure 3:
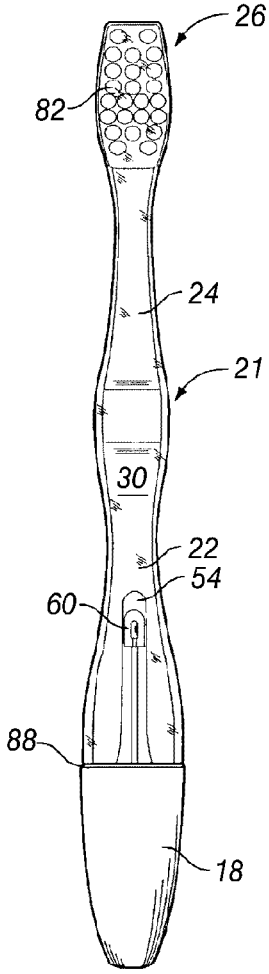
FIG. 3 (PRIOR ART)
FIG. 3 is a rear elevation view of the toothbrush of FIG. 1 showing the non-brush side of the toothbrush.

FIG. 1 illustrates a prior art illuminated toothbrush 10, which comprises a handle 12, an illumination circuit 14, a brush 16, and a grip 18.

As shown in FIG. 1, the handle 12 comprises a base 20, a body 21, and a head 26. The body 21 has a first section 22 and a second section 24. The handle 12 can be formed of hard, clear plastic. In one arrangement, the handle 12 can be a colored plastic. In another arrangement, the handle 12 can be a translucent plastic. In yet another embodiment, the handle 12 may be fashioned out of a plastic incorporating metallic flake 55.

The toothbrush handle 12 can be formed through an injection molding process. In such an embodiment, plastic in a liquid form can be injected into a mold having two sections. Liquid plastic can be injected into the mold where it is then allowed to solidify. When the mold is opened it creates a handle having a brush side 28 and a non-brush side 30. At the intersection of these two sides 28, 30 can be a ridge 32. The ridge 32 can be a surface characteristic resulting from the injection molding process. In the illustrated arrangement, the ridge 32 does not extend inside the handle 12 but exists on the surface. The injection molding process in constructing of the toothbrush handle 12 is conventional and does not form a part of the present invention.

Figure 5:
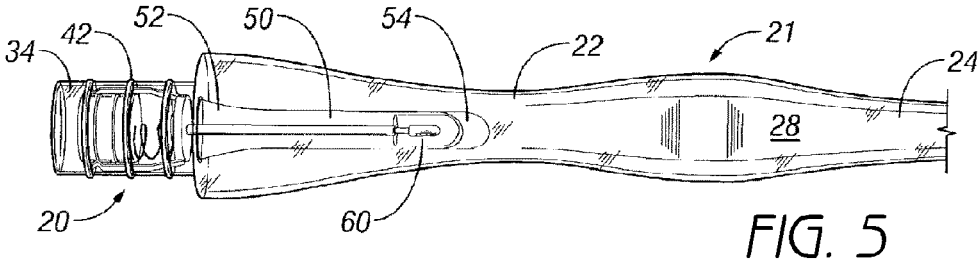
FIG. 5 (PRIOR ART)
FIG. 5 is a top view of the toothbrush with the grip removed exposing the toothbrush base and illumination circuit held within.
Figure 6:
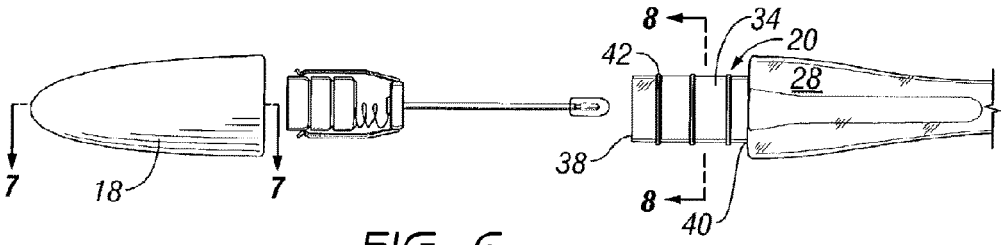
FIG. 6 (PRIOR ART)
FIG. 6 is an exploded top view of the toothbrush grip, base, and lower section of toothbrush handle showing the placement of the illumination circuit within the toothbrush handle.
Figure 8:
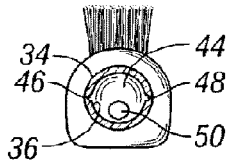
FIG. 8 (PRIOR ART)
FIG. 8 is a sectional view of the base in FIG. 6 showing the indentations for containing the positive terminal conductors.
Figure 9:
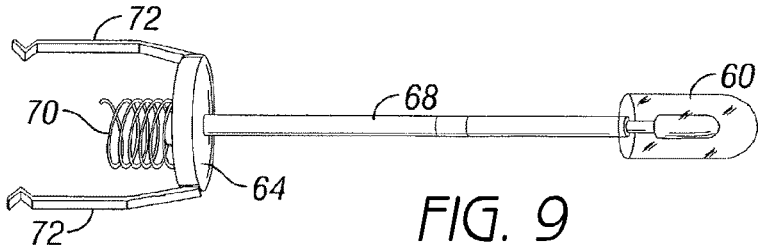
FIG. 9 (PRIOR ART)
FIG. 9 is a perspective view of the illumination circuit without the power supply.
Figure 10:
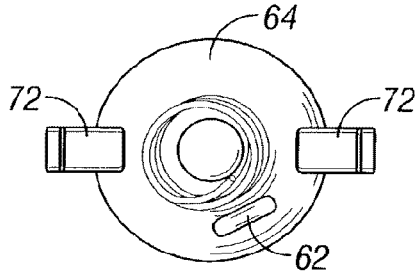
FIG. 10 (PRIOR ART)
FIG. 10 is a bottom view of the illumination circuit.
Figure 11:
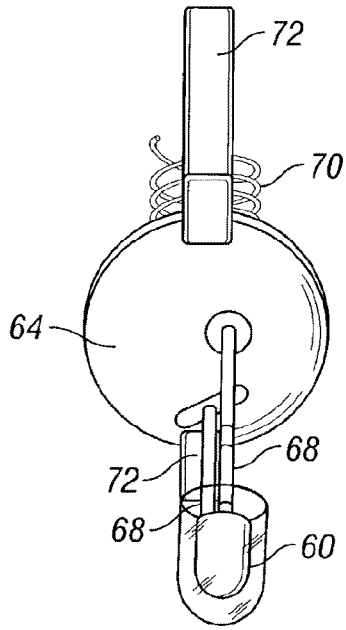
FIG. 11 (PRIOR ART)
FIG. 11 is a top perspective view of the illumination circuit.

As seen in FIGS. 5, 6, and 8, the handle 12 can include a handle base 20. The base 20 can be generally cylindrical in shape and can have a circumferential groove or cavity 44 therein. The circumferential groove 44 can have a centerline. The base 20 has an outside surface 34, an inside surface 36, a first end 38, and a second end 40. In the illustrated arrangement, on the outside surface 34 of the base 20 are three annular rings 42. The annular rings 42 can provide a ledge upon which the grip 18 holds.

The inside surface 36 defines the cavity 44. The inside surface 36 can have a first indentation 46 and a second indentation 48. The cavity 44 can serve as a housing for the illumination circuit 14. The first and second indentation 46, 48 can serve as a guide for positioning the illumination circuit 14 within the base 20.

A chamber 50 can extend within the section 22. The chamber 50 has a first end 52 and a second end 54. The chamber 50 can be generally cylindrical in shape. The first end 52 can be rounded and can provide a transition between the chamber 50 filled full of air and the first section 22 which is of plastic. The air is inherently present as a result of assembly at a time after the handle was formed. Alternatively, the chamber may be filled full of a material in a process separate from the forming of the handle.

The second end 54 of the chamber 50 can be open to the first end 38 of the base 20. The first section chamber 50 can be in off-center alignment with the base 20. As seen in FIG. 8, the first section chamber 50 is in off-center alignment with the base 20 to allow the projector of a light beam or illuminating member 60 to emit a light beam 56 that travels through the first section 22 and to strike the interface 65 between the second section 24 and atmosphere. At this interface, a light beam 57 can be reflected towards the handle head 26 and a light beam 58 can be refracted towards the atmosphere.

The first section chamber 50 can be also positioned in off-center alignment with the base 20 because in the first section 22 is ergometrically designed to accommodate a user's grip. In the ergometric design, the brush side 28 of the first section 22 is contoured and the non brush side 30 of the first section 22 is flat. In addition, the brush side 28 of the first section 22 arrives at a point of the second section 24 at a greater angle than the non brush side 30. In other words, the illumination circuit 14 extends within the first section 22 substantially parallel to the center line of the base member 20 but the first section 22 brush side 28 angles toward the inner point where the first section 22 meets the second section 24 and the non brush side 30 portion of the first section 22 also angles toward the point where the first section 22 meets the second section 24. Thus, for the first section chamber 50 to extend the furthest into the first section 22 of the handle 12, the first section chamber 50 is preferably positioned closer to the non-brush side 30 of the first section 22.

The illumination circuit 14 can have an illuminating member or projector of a light beam 60, a resistor 62, a timing circuit 64, and a power source 66. These parts can be joined by the conductor 68, which provides a support structure extending the illuminating member 60 a distance away from the timing circuit 64. The negative terminal conductor 70 can be a spring which presses against the power source 66, which in the illustrated arrangement comprises a series of batteries. The positive terminal conductor 72 can comprise a pair of prongs that extends away from the timing circuit 64 to embrace the power source 66. The positive terminal conductor 72 can also be sized to stabilize the illumination circuit 14 within the base 20 as the positive terminal conductor 72 is sized to fit within the first indentation 46 and the second indentation 48 of the base 20.

The illumination member 60 in this embodiment is a light emitting diode (LED). In other embodiments, the illumination member 60 could be an incandescent light bulb. In still other embodiments, the illumination member 60 may be any other device known in the art that may provide illumination.

The power source 66 in one arrangement can be micro-cell battery model number G3-ACNB. In the illustrated arrangement, three batteries are placed in series within the base 20. The timing circuit 64 preferably can function to illuminate the illumination member 60 for approximately 60 seconds. The timing circuit 64 also preferably can serve to control the illumination member 60 to blink intermittently for the time period in which it is engaged. In some embodiments, the illumination member 60 may stay on continuously and/or illuminate for a longer or shorter period of time. In the illustrated embodiment, the circuit is activated by closing an electrical switch 74 to complete a circuit.

The brush 16 can have a bristle 80. The bristle 80 can have a first end 82 and a second end 84. The bristle second end 84 can be embedded in the head 26 of the handle 12. In one arrangement, the bristle 80 can be made of clear plastic material. Moreover, in such an arrangement, the brush 10 can be configured such that, when the bristle 80 is struck by light traveling from the illumination member 60 through the first section 22 and the second section 24, a portion of the light striking the bristle 80 may reflect through the bristle 80 and extend out of the bristle 80.

Figure 4:
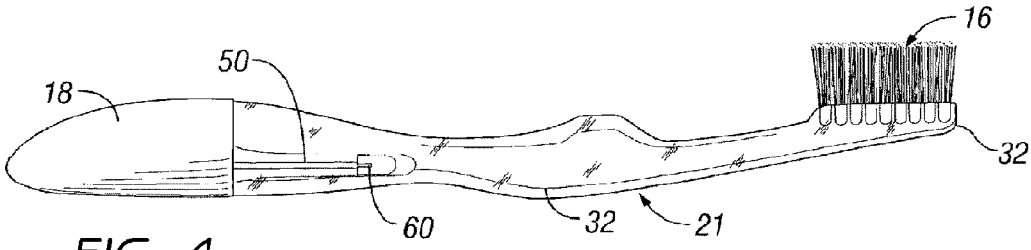
FIG. 4 (PRIOR ART)
FIG. 4 is a side view of the toothbrush of FIG. 1 showing the chamber preferentially placed near the non-brush side.
Figure 7:
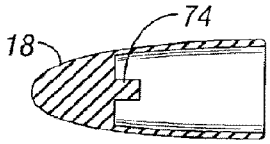
FIG. 7 (PRIOR ART)
FIG. 7 is a sectional view of the grip of FIG. 6.

The grip 18 can be made of a flexible material. In the illustrated arrangement, the grip 18 can also serve as a switch. For example, the grip 18 can have an extending piece or switch 74 of flexible material as seen in FIG. 7. When the grip is pushed in the direction of arrow A in FIG. 4, the piece 74 moves the positive terminal metal conductor 72 to contact the power source 66. Alternatively, the piece 74 moves the power source 66 to contact the positive terminal metal conductor 72. In doing so, the piece 74 moves illumination circuit 14 from an un-illuminated position to an illuminated position. The grip 18 can remain in place on the base 20 by engaging the annular rings 42 on the outside surface 34 of the base 20. An adhesive 88 can be positioned between the first section 22 and the grip 18 to hold the grip 18 in close connection with the first section 22.

The grip 18 can be made of a flexible material. Alternatively, the grip 18 may be of a hard material but have a flexible portion that may be used to engage the positive terminal conductor 72 and press against the power source 66.

In operation, the illuminated toothbrush 10 is used by a user to indicate the duration of an amount of time. The user grips the toothbrush handle 12 in their hand with the bristle 80 surface with the bristle 80 against their teeth and engages the illumination circuit switch 74. The illumination member 60 begins to blink intermittently in an on/off fashion. The illumination member 60 continues to blink for a period of approximately 60 seconds. The handle is designed to direct light to the user in multiple ways so that the user may be accurately apprised of brushing time. The frequency of blinking can remain constant, or vary in frequency. In some embodiments, the frequency can increase as the time approaches 60 seconds. In some embodiments, the frequency can remain constant through a first period of time, and increase in frequency in a second period of time. In one example, the frequency can remain constant for approximately 45 seconds; then increase for the remaining 15 seconds. In other embodiments, different time intervals can be used, such as, for example, two even periods of thirty seconds each.

A light beam 59 travels from the illuminating device 14 through a first section chamber 50. The light beam 59 strikes an interface 63 between the first section chamber and the first section and a light beam 61 is partially reflected off of the interface and a light beam 56 is refracted enters the first chamber. The light beam 56 travels through the first section 22 to strike upon an interface 65 between the second section 24 and atmosphere. A light beam 57 is reflected from interface 65 toward head 26 and a light beam 58 is refracted towards the atmosphere. The light beam 57 then strikes an interface 116 between the head 26 and bristle 80 where it is partially reflected and refracted.

Alternatively, the toothbrush handle may have a metallic piece 55 or flake embedded in the hardened plastic. The angle of reflection upon the flake is equal to the angle of incidence upon the flake. These metallic pieces 55 can be glitter. In operation, light will strike these metallic pieces 55 at an angle of incidence and the reflected light beam 67 directed at an angle of reflection as seen in FIG. 1.

One disadvantage of the arrangement described above is that the mechanism for completing the activation of the illumination is mechanically inefficient and often requires a degree of strength and dexterity not possessed by children.

Figure 13:
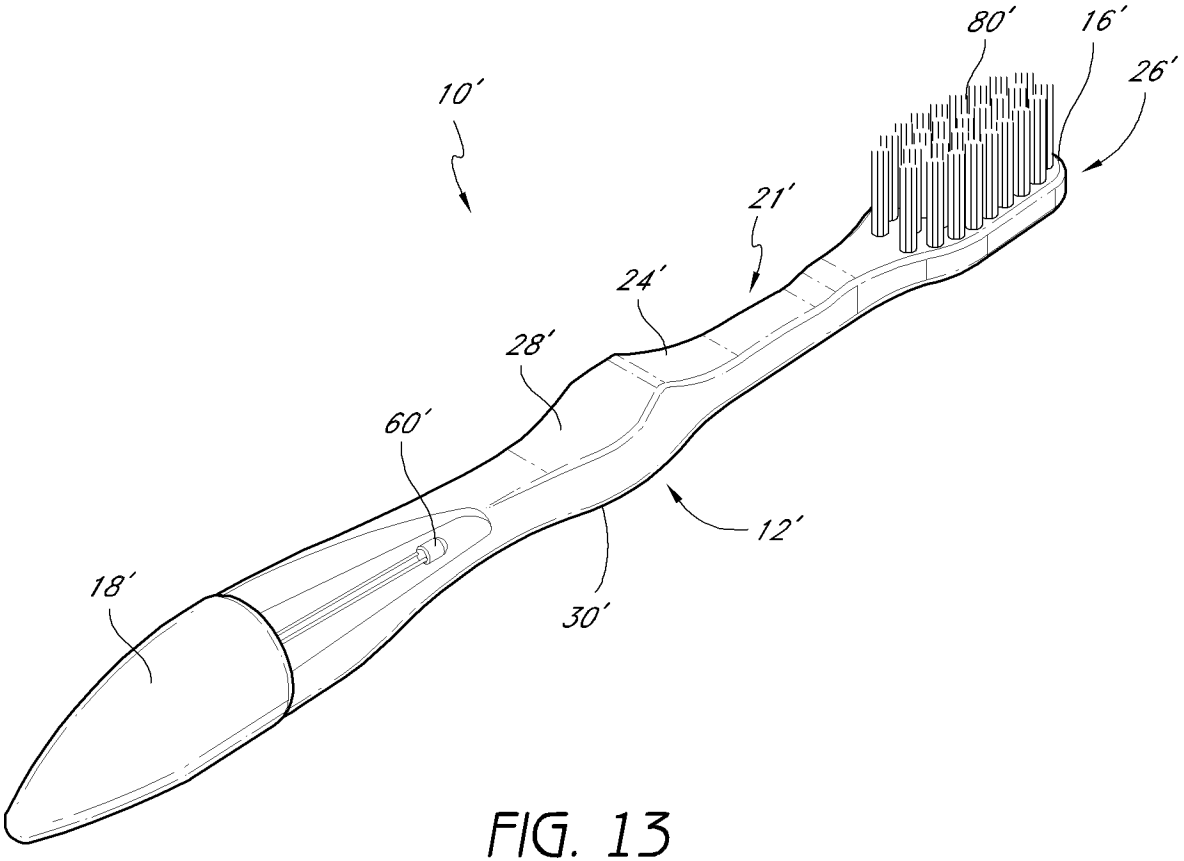
FIG. 13 is a brush side perspective view of a toothbrush having certain features and advantages according to the present invention.
Figure 14:
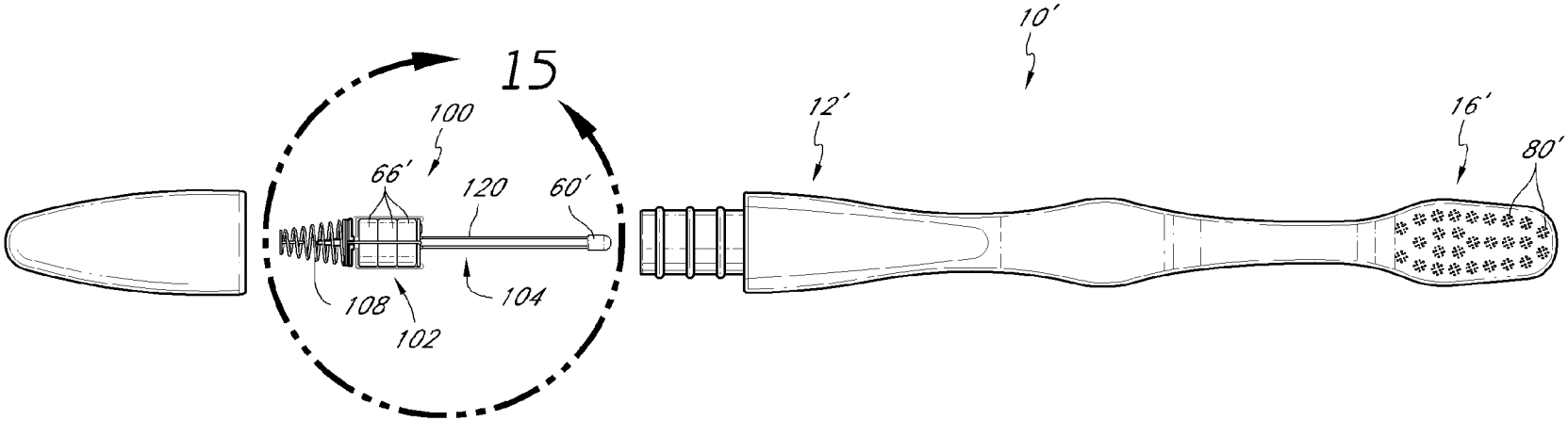
FIG. 14 is top brush side exploded view of the tooth brush of FIG. 13.
Figure 15:
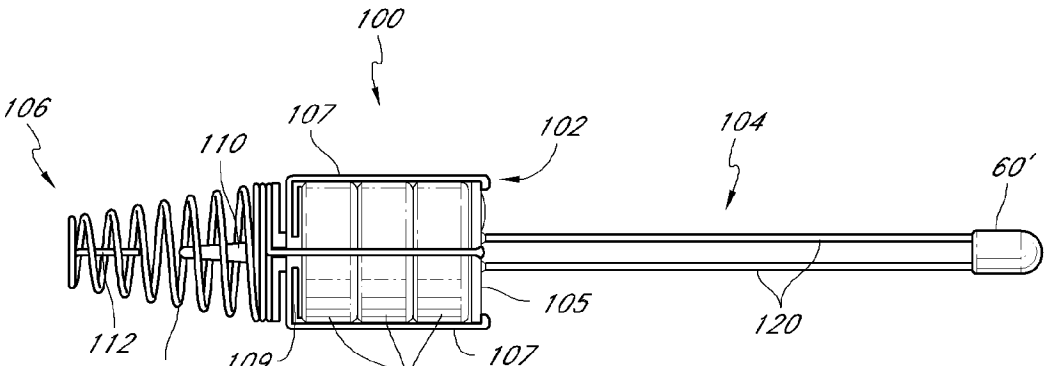
FIG. 15 is a closer view of section 15 of FIG. 14.

FIGS. 13, 14, and 15 illustrate a modified embodiment of a toothbrush that advantageously addresses the aforementioned problem. Numerical reference to components is the same as in the previously described arrangement, except that a prime symbol (') has been added to the reference. Where such references occur, it is to be understood that the components are the same or substantially similar to previously described components.

As can be seen the toothbrush can have an improved light generation mechanism 100. The mechanism 100 can be disposed in the base 18', as described above. In the illustrated embodiment, the mechanism 100 comprises a power portion 102, an extension portion 104, and an activation portion 106. The illuminating member 60' can be disposed at one end of one or more extension members 120, which can form the extension portion and can extend toward the base 18' and couple with the power segment 102.

The power segment 102 can comprise one or more power sources (e.g., batteries) 66'. The power sources 66' can be positioned between a distal member 105 and a proximal member 109, which in one embodiment can each comprise a circular disk-like plate. The power sources 66' can be secured in the space between the distal and proximal members 105, 109 and can be engaged by one or more generally rigid elongate members 107. The elongate members 107 can extend along the longitudinal axis of the toothbrush 10'. For additional security, the power sources 66' can be surrounded by a cylindrical member (not shown) that can be made of plastic or other similar material. In this manner, the power sources 66' cannot be easily dislodged from the power segment and swallowed by children if the base 18' is removed.

The power sources 66' can be in direct contact with each other or have an intervening electrical connection member (not shown). The power segment 102 can be coupled to an activation segment 106. The activation segment 106 can have a spring member 108. The spring member 108 can be a conical, as in the illustrated embodiment, or cylindrical, or any other shape appropriate for the interior or the base 18'. The spring member 108 can be composed of metal, though other materials can be used in other embodiments. Advantageously, an electrically-conducting material can be used. The spring member 108 can have an inward-extending protrusion 112 at one end. The protrusion 112 can be of any size or shape sufficient to extend towards the power sources 66' without contacting them. The protrusion 112 can be composed of the same material as the spring member 108, or can be composed of a different material, preferably an electrically-conductive material. In certain embodiments, the spring member 108 can be composed of a plastic and the protrusion 112 can be a metal. The spring member 108 can have an insulating or conducting coating.

The power segment 102 can have a contact member 110 extending toward the protrusion 112. The contact member 110 can be electrically-connected to the power sources 66' and the illumination circuit 14'. The contact member 110 can be connected such that contact with the protrusion 112 activates the illumination circuit 14'. Additionally, when electrically-conducting materials are used for the spring member 108, such as the metal in the illustrated embodiment, contact between the sides of the flexible member 108 and the contact member 110 can also activate the illumination circuit 14'.

Thus, although the illustrated embodiment is shown in FIGS. 14 and 15 in an exploded view, when the toothbrush 10' is assembled as in FIG. 13, manipulation of the pliable base 18' can cause deflection of the spring member 108 within. If the bottom of the base 18' is pushed toward the power segment 102, the protrusion 112 can touch the contact member 110, causing illumination. Alternatively, if the base 18' is deflected towards either side, the interior of the spring member 108 can touch the contact member 110, also causing illumination. The illumination can be continuous or intermittent. Additionally, the intervals between illuminations during intermittent operation can be regular or have increasing or decreasing frequency.

Figure 16:
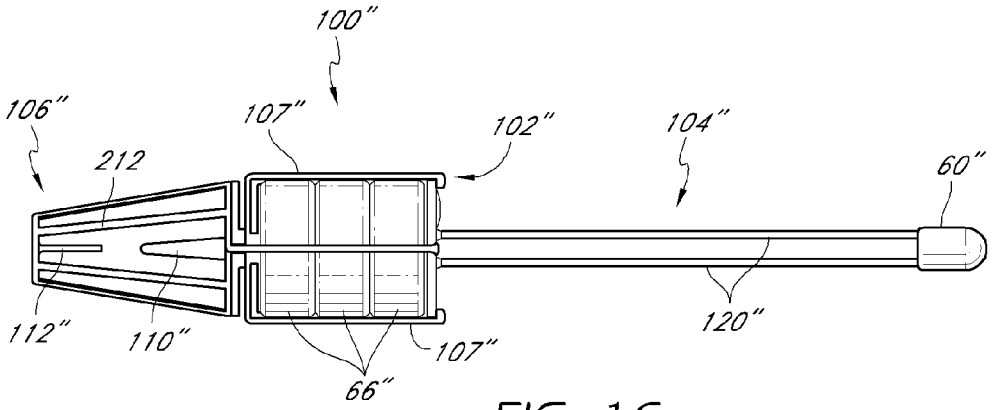
FIG. 16 is another embodiment of an illumination circuit.

FIG. 16 illustrates another embodiment of an illumination circuit. Numerical reference to components is the same as in previously described arrangements, except that a double prime symbol (") has been added to the reference. Where such references occur, it is to be understood that the components are the same or substantially similar to previously-described components.

Figure 12:
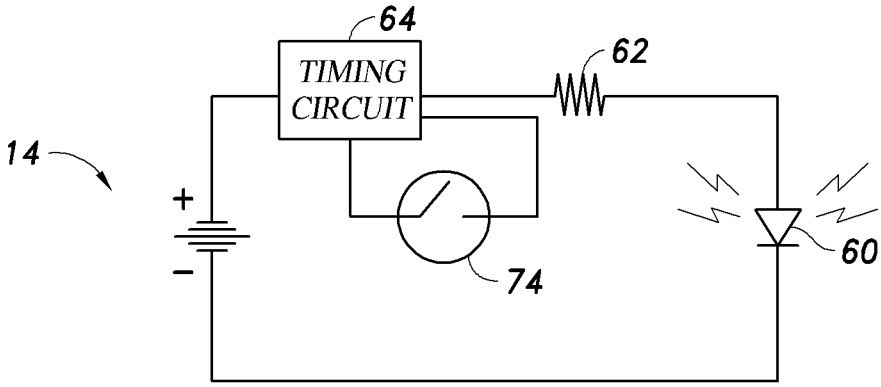
FIG. 12 is a schematic drawing of the illumination circuit.

As in other embodiments, a contact member 110" can be attached to a power segment 102". The contact member 110" can activate a circuit 14", as illustrated in FIG. 12. The embodiment of a mechanism 100" depicted in FIG. 16 has a plurality of flexible members 212 which enclose the contact member 110". The flexible members 212 can be composed of metal, an elastomer, or any of a variety of other materials which permit flexibility and have, or can support, an electrically-conductive surface. An inward-extending protrusion 112" can be integrally formed with the flexible members 212.

Unlike the cone-shaped spring member depicted in the embodiment illustrated in FIG. 15, the flexible members 212 can extend along a longitudinal axis of the mechanism 100". In some embodiments, the flexible members 212 taper inwardly as they extend away from the contact member 110". In other embodiments, the flexible members 212 do not taper, and maintain an approximately cylindrical shape. In yet other embodiments, the flexible members 212 can have other arrangements, including without limitation, a pyramidal prism, a rectangular prism, a cubic shape, or other geometrical shapes sized appropriately to surround the contact member 110".

Figure 17:
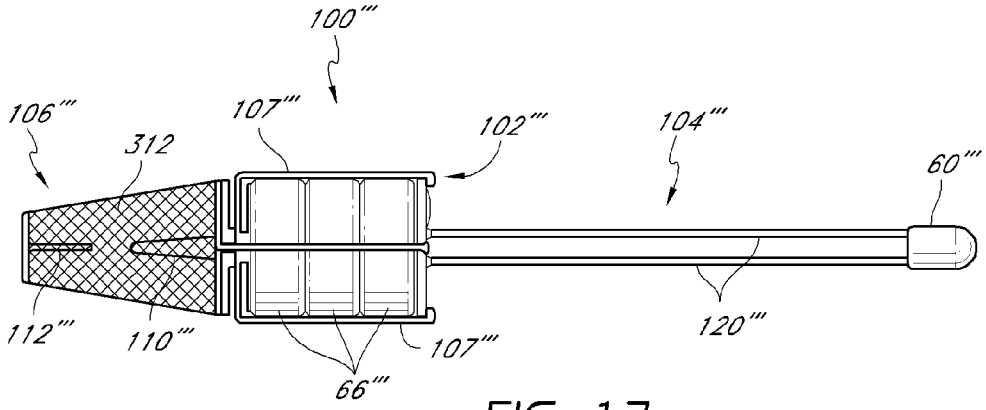
FIG. 17 is another embodiment of an illumination circuit.

FIG. 17 illustrates another embodiment of an illumination circuit 100'''. Numerical reference to components is the same as in previously described arrangements, except that a triple prime symbol (") has been added to the reference. Where such references occur, it is to be understood that the components are the same or substantially similar to previously-described components.

The contact member 110''' can be enclosed within a flexible mesh, such as a metal wire mesh 312. The mesh 312 can have an interior contact surface which activates the illumination circuit 100''', or can structurally support such a surface. The wire mesh 312 can have an inward-extending protrusion 112''', as illustrated. In some embodiments, more than one protrusion is present on the interior of the component disposed around the contact member 110'''. These embodiments can include the use of spring members, flexible rods, flexible meshes, or any other contact surface or surface support configured to activate the illumination circuit.

Figure 18:
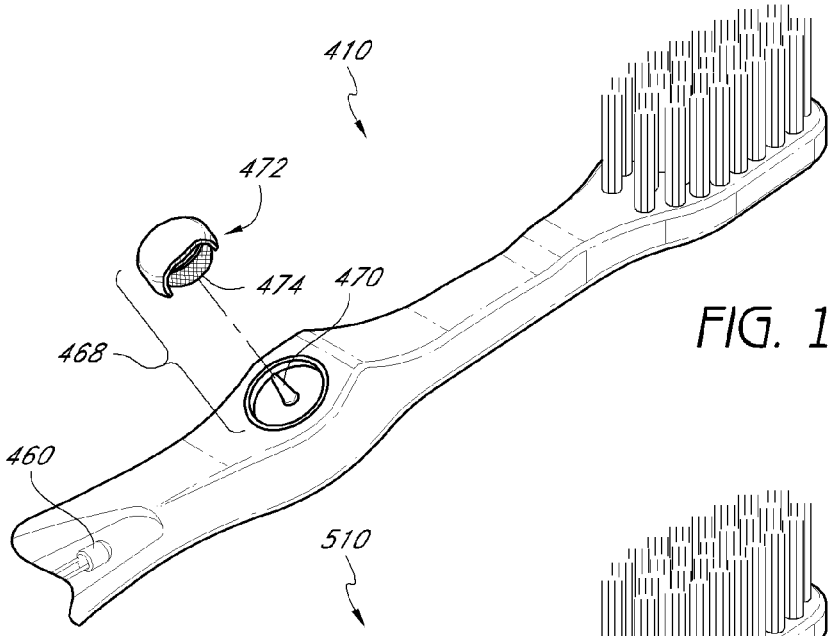
FIG. 18 is a perspective view of an embodiment of a toothbrush with a front-mounted button.
Figure 19:
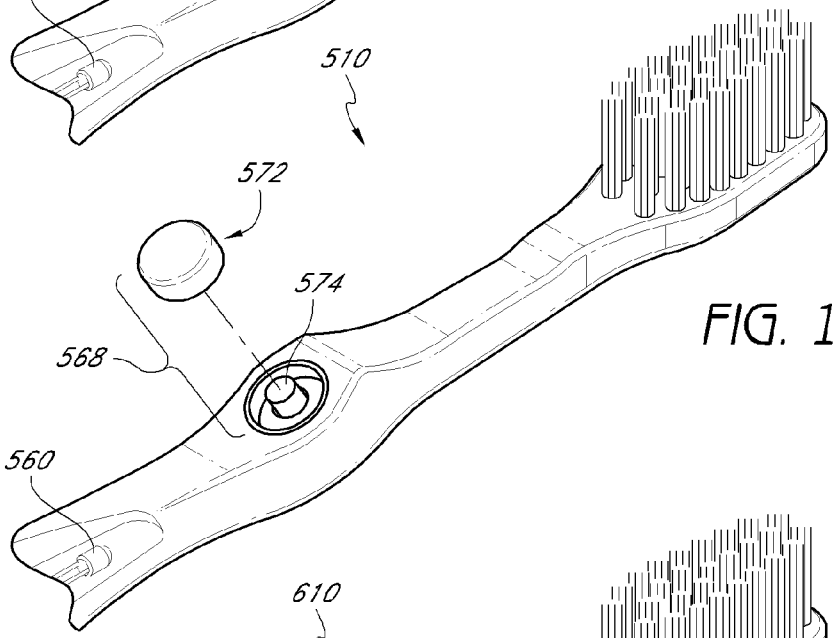
FIG. 19 is a perspective view of another embodiment of a toothbrush with a front-mounted button.
Figure 20:
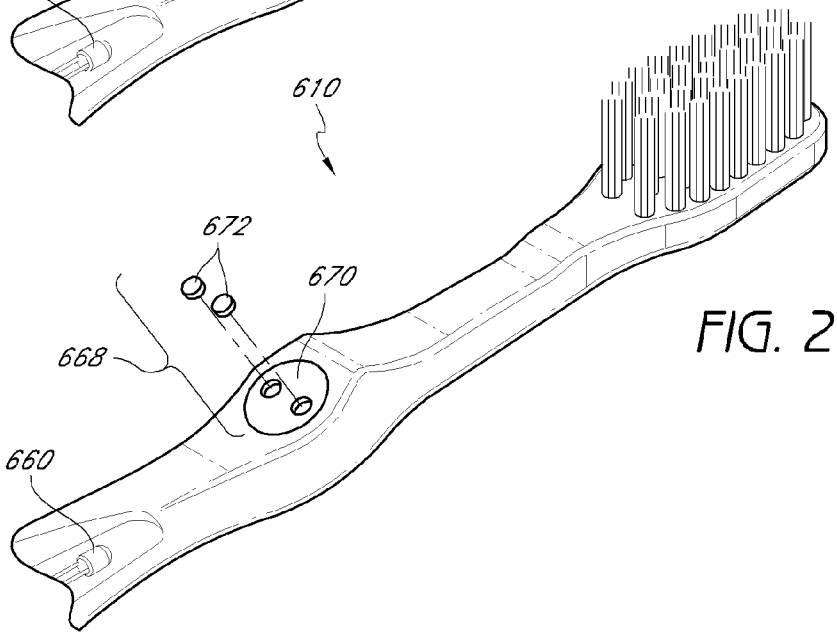
FIG. 20 is a perspective view of another embodiment of a toothbrush with a front-mounted button.
Figures 21A, 21B, 21C:
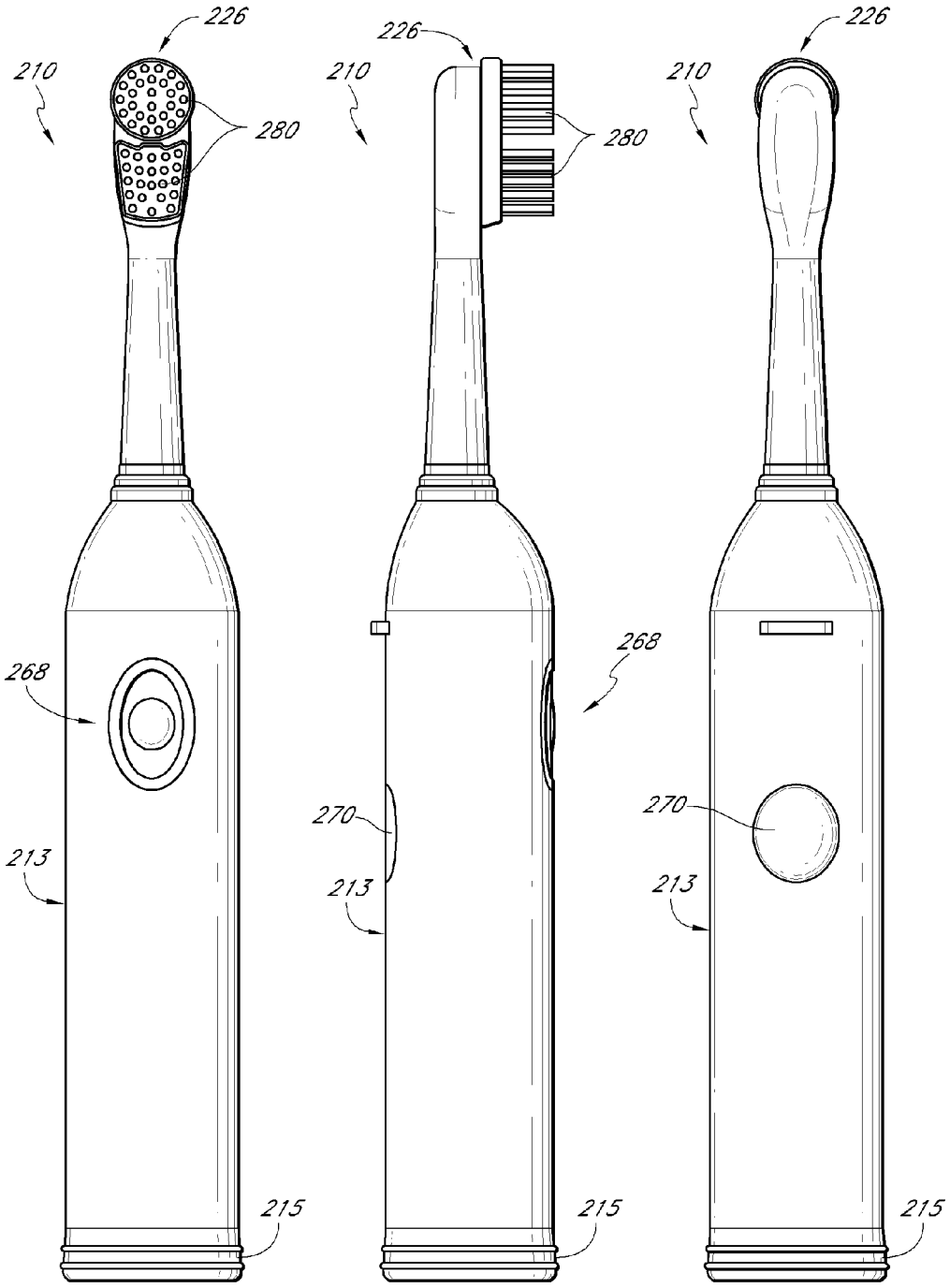
FIG. 21A-C is an embodiment of an electric toothbrush.

FIGS. 18-20 illustrate alternative embodiments of the toothbrush having a front-mounted activation mechanism for activating an illumination circuit 14. The mechanism can comprise a variety of devices, some examples of which are illustrated and described below.

FIG. 18 illustrates an embodiment of a toothbrush 410 having an illumination member 460 and an activation mechanism 468. The mechanism 468 can comprise a contact port 470 and a button 472. The button 472 can comprise a metallic mesh 474 that surrounds the contact post 470, and activates an illumination circuit 14, lighting the illumination member 460, as described above. The mesh 474 can case the illumination circuit 14 to activate through contact with an electrically-conducting inner surface, or support an electrically-conducting surface which activates the circuit 14. The mesh 474 can be replaced by a spring, flexible rods, or any other suitable device, as described above.

FIG. 19 illustrates another embodiment of a toothbrush 510 having a front-mounted activation mechanism. The mechanism can comprise a push-button device 568 having a button 572 and a switch device 574, as are well-known in the art. The push-button device 568 can cause the illumination member 560 to blink by activating an illumination circuit 14. The switch device 574 can be activated by manipulation of the button 572, whether the button 572 is flexible or a rigid connection to the switch device 574. The push-button device 568 can activate the circuit 14 once manipulated, and future manipulations can be ignored by the circuit 14 until the timer has completed a cycle. This operation can occur in any embodiment described herein.

FIG. 20 illustrates another embodiment of a toothbrush 610, wherein an illumination member 660 is set to blink by an illumination circuit 14. The circuit 14 can start a timed cycle upon receiving a signal from an activation device 668. In the illustrated embodiment, the activation device 668 comprises a base 670 and two contact terminals 672. The contact terminals 672 can activate the circuit 14 when electrical conduction occurs between the terminals 672. In one embodiment, the circuit 14 and terminals 672 can be constructed to allow contact with human skin to both terminals 672 to cause conduction to occur, thereby activating the circuit 14. In non-limiting examples, the palm of a human hand gripping the toothbrush can activate the circuit or, a finger or thumb pressed to touch both terminals 672 can activate the circuit 14. Water disposed in continuous contact with both terminals 672 can also activate the circuit 14.

FIGS. 21A-22B illustrate an embodiment of an electric toothbrush 210. The toothbrush 200 can include a motor 220 configured to impart motion to at least part of the bristles 280. For example at least part of the bristles 280 can oscillate, rotate, and/or vibrate. Different sections of the bristles 280 may move differently from another section and may include a stationary section.

As shown, the electric toothbrush 210 has a head 226, and a handle 213. Bristles 280 are connected to the head 226. The electric toothbrush 210 is also shown with an activation mechanism 268 and a window 270. The activation mechanism 268 can be used to turn the motor 220 on and off. The activation mechanism 268 can also be used to start a timing circuit. Though a particular activation mechanism 268 is shown, an electric toothbrush can use any of a number of different activation mechanisms portions including those described elsewhere herein.

The window 270 can be made from translucent material, such that light from an illumination member 260 can be seen through the window 270. The window 270 can define a particular shape in the toothbrush, such as the illustrated oval window 270 within the handle 213 or a section of the toothbrush, such as a neck portion between the handle and the head or a top of the handle. The illumination member 260 can be a light bulb, an LED, an array of LEDs, or any other source of light, such as has been discussed previously. The illumination member 260 can be a single color or can be multicolored.

Figure 22A:
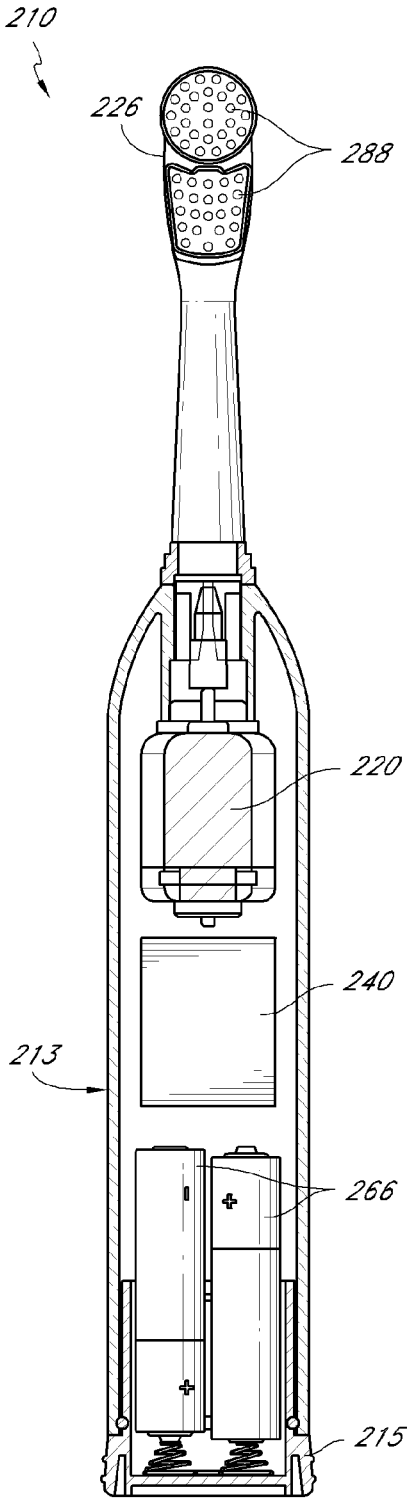
FIG. 22A is front view of the electric toothbrush of FIGS. 21A-C with the toothbrush partially disassembled and partially in cross-section.
Figure 22B:
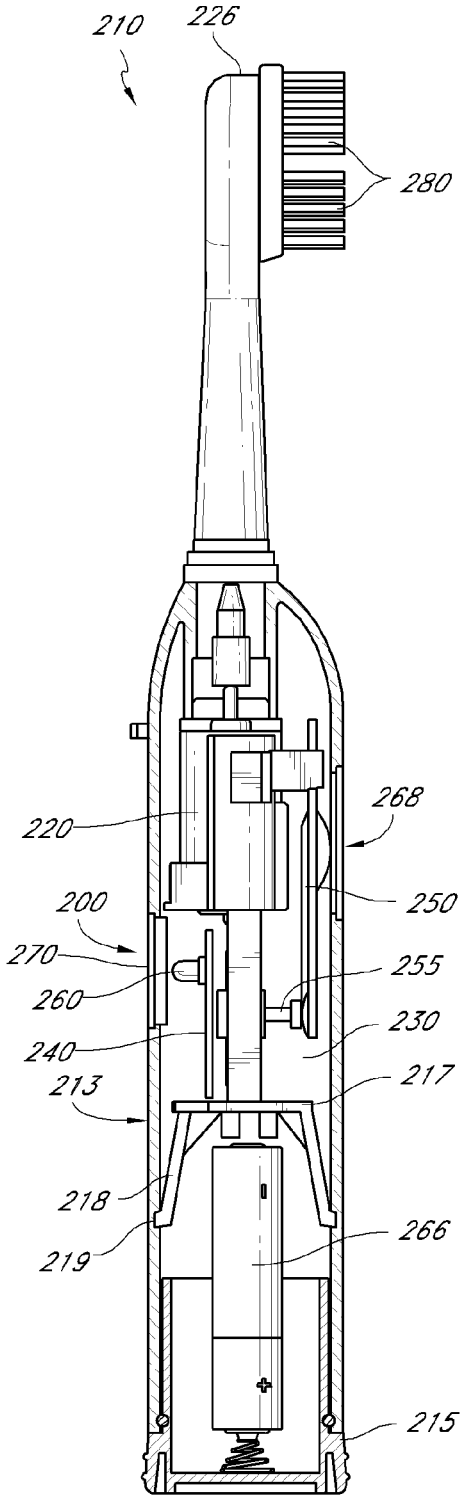
FIG. 22B is side view of the electric toothbrush of FIGS. 21A-C with the toothbrush partially in cross-section.

Referring now to FIGS. 22A-B, an internal chamber 230 can be seen within the electric toothbrush 210. The internal chamber 230 can serve as a housing for the various components of the electric toothbrush 210. The components can be completely or partially within the chamber 230. These components can include a motor 220, one or more power sources or batteries 266 and an activation mechanism 268. A cap 215 can used to gain access into the internal chamber 230. A frame 217 can be used to secure one or more of the components in place within the chamber 230.

In addition to driving a motor, the electric toothbrush 210 can include an illumination circuit 200 similar to those previously described. The illumination circuit can be connected to or can be separate from a motor drive circuit. In some embodiments, the motor drive circuit can be controlled by the activation mechanism 268. For example, pressing the activation mechanism 268 can close the circuit, turning the motor on and pressing the activation mechanism 268 a second time can open the circuit, turning the motor off. In some embodiments, the motor drive circuit can include a timer such that the motor is turned on for a limited duration, or the motor speed can change after a certain duration. For example, the duration can be determined by the timer. The duration can be 15 seconds, 30 seconds, 45 seconds, 60 seconds, 1.5 minutes, 2 minutes, etc.

As shown, the electric toothbrush 210 can include a printed circuit board (PCB) 240. The PCB 240 can be used in forming various electrical connections and circuits within the electric toothbrush 210. For example, the illumination member 260, motor 220, power source 266, activation mechanism 268 and other components of the illumination circuit 200 and/or the motor drive circuit can be connected to the PCB 240.

A frame 217 can be used to secure one or more of the components in place within the chamber 230. As shown, the frame 217 can be configured to surround a portion of the motor 220, while also securing the PCB 240 and the activation mechanism 268. In some embodiments, the frame 217 can include one or more legs or prongs 218. The prongs 218 can be used to engage the side wall of the internal chamber and secure the frame in place within the chamber. For example, the frame can be used to assemble at least some of the electrical components and/or internal components of the electric toothbrush 210 while outside of the toothbrush. The frame can then be inserted into the toothbrush. This can provide an efficient method of assembling an electric toothbrush. In some embodiments, the prongs 218 can engage a slot or hole 219 in the side wall of the internal chamber 230.

In some embodiments, the prongs 218 can also be used to position the power sources or batteries 266 within the internal chamber 230. For example, the prongs can be contoured to prevent a battery from moving from one side to another within the internal chamber 230.

In the illustrated embodiment of FIG. 22B, the activation mechanism 268 includes a lever 250 and a button 255. Depressing the lever 250 will also depress the button 255. The button 255 is connected to the PCB 240 and can activate the various circuits.

In some embodiments, the motor 220 can be turned on and off by the activation mechanism 268, while the illumination member 260 can be turned on by the activation mechanism 268 but thereafter controlled by the timer. For example, the illumination member 260 can remain illuminated for a certain duration, flash for a certain period of time, or illuminate after a certain period of time. The action of the illumination member can also change during a set duration. In some embodiments, the illumination member 260 can indicate to a user when a certain recommended time period for brushing teeth has passed and the user can then turn off the motor.

In some embodiments, both the illumination member 260 and the motor 220 can be connected to the timer. In this way, the functioning of the illumination member 260 and the motor 220 can coordinated. For example, the motor can be on for set period of time controlled by the timer and the illumination element can be used to indicate that and/or other time periods to a user. These time periods can include, among other things: the half way point, and/or when 60, 50, 45, 40, 30, 25, 20, 15, 10, and/or 5 seconds remain and/or when the time is up.

The activation mechanism 268 can also be used to turn off the illumination member 260 and/or the motor 210, whether or not a certain time period established by the timer has been completed.

The illumination member 260 can be located in many different positions within the electric toothbrush 210. In some embodiments, the illumination member 260 will be positioned next to or near the window 270, while in some embodiments, the illumination member will not be close to the window 270, yet light from the illumination member 260 will still be visible through the window 270.

Preferably, the window 270 will be located on the side of the toothbrush 210 opposite the bristles 280 or otherwise in a manner so that a user can see the window 270, illumination member 260 and/or light from the illumination member 260 in a mirror positioned in front of the user, such as a wall hanging bathroom mirror, while the user is brushing his or her teeth. In this way the illumination member 260 can readily be used to provide information to a user concerning a time period for brushing teeth. The use of a precisely placed window 270 also allows the other internal workings of the electric toothbrush 210 to remain hidden. Another benefit of having the window 270 on the back side of the handle 213, as shown, is that it avoids shining the light directly into the user's eyes.

In some embodiments, the window 270 can be frosted over, include a graphic, and/or otherwise prevent someone from viewing the internal components of the electric toothbrush 210 while still allowing light to pass through the window. In some embodiments, the window 270 can have embossing, or inscriptions.

The window 270, in some embodiments, can be a lithophane-like window. A lithophane generally refers to an etched or molded artwork in thin translucent porcelain that can only be seen clearly when back lit with a light source. A lithophane can present a three dimensional image that can change characteristics depending on the light source behind it.

In some embodiments, the window can be made of plastic of varying thickness. When light is shined through the window, the varying thicknesses of plastic can present an image because not all of the light will shine through the plastic to the same degree. Thus, thicker regions will be darker than thinner regions. The window can also be made from other materials besides plastic. Depending on the design, the image may be partially or completely visible without a direct source of light shining through the window.

The lithophane-like window 270 can also be made in ways other than that described above. For example, the window can have a varying thickness and/or can be imprinted with ink or other coatings such that the image is seen clearly when light shines through the window. Ink or other coatings can be used to create a similar affect to the varying thickness of material. Likewise, different materials can be joined together or used to create a lithophane-like affect. Certain methods of manufacture for a lithophane-like article are discussed in International Patent Cooperation Treaty Ap. No. PCT/GB99/01936 published as WO 00/20185, incorporated by reference herein.

The lithophane-like window 270 can present an image such as a cartoon character, a symbol, a brand name, or other feature that can be seen while the electric toothbrush is activated and the light is on. In some embodiments, the window 270 can include a combination of various aspects including lithophane-like, embossing, inscriptions, printing, etc.

The window 270 can be various shapes and sizes and can be placed in various positions along the handle 213. For example, the window 270 can be sized and shaped to be viewed from multiple directions or all directions. As another example, the window 270 can wrap around the handle to allow viewing from all directions. For example, FIGS. 21B, C and 22B show the window 270 at the back of the handle 213 and close to midway between the top and bottom of the handle yet closer to the top in the illustrated embodiment. In one embodiment, the window 270 is positioned on the handle 213 generally opposite the activation mechanism 268 with a portion the window 270 and the activation mechanism 268 being positioned generally above a gripping portion of the handle 213. In one embodiment, the gripping portion is defined by gripping aids (e.g., dimples, grooves, and/or softer or more pliable material added or formed onto the handle 213). In another embodiment, the window 270 is positioned above the top 10% of the gripping portion and/or gripping aids and in another embodiment above the top 25% of the gripping portion and/or gripping aids.

Figure 23:
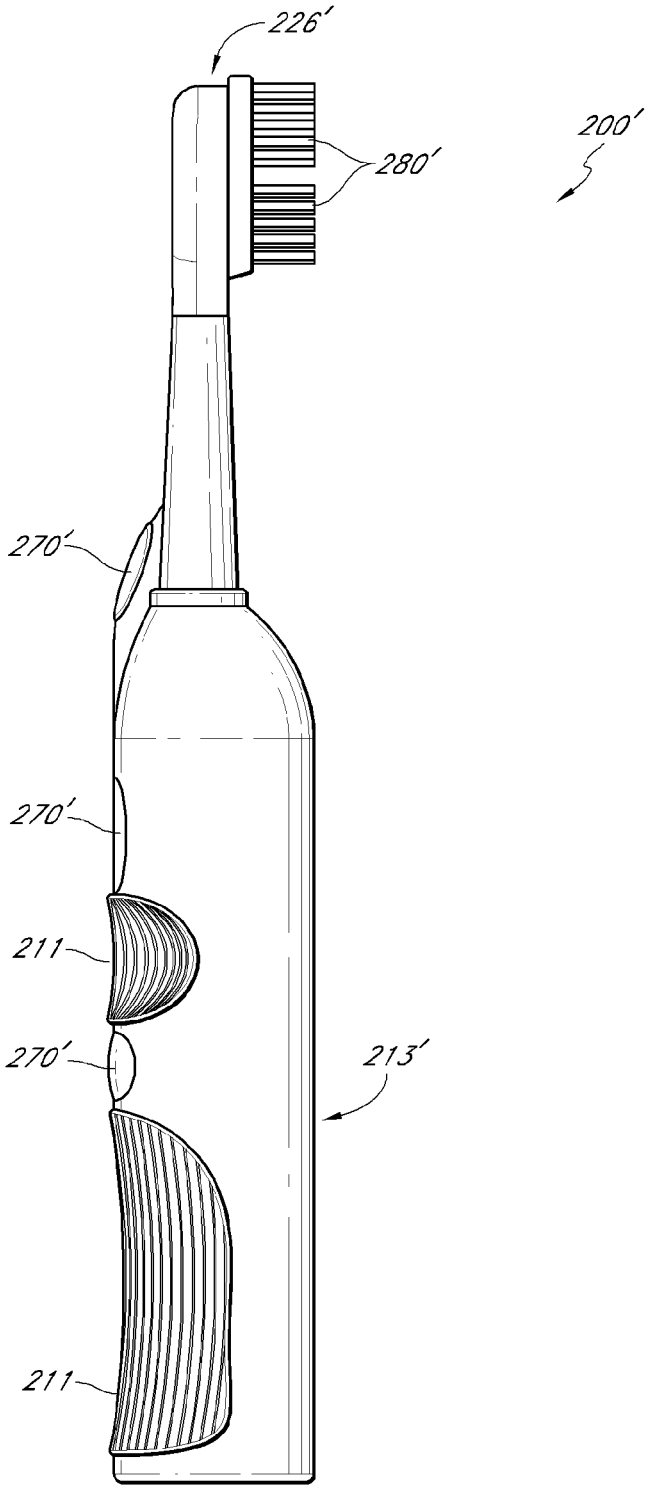
FIG. 23 shows another embodiment of an electric toothbrush.

In some embodiments, the window 270 and the handle 213 can be configured such that light from the illumination member 260 can be seen through a user's hand or fingers, in-between the users fingers, or above or below the fingers and hand. In some embodiments, the handle 213 can be configured such that gripping the handle at a grip section 211 opens the fingers to allow light to pass through the space between the fingers. Many of these embodiments and configurations can also be seen in the electric toothbrushes 200', 200" of FIGS. 23 and 24. For example, in FIG. 23, in one embodiment, the window 270' is located between two gripping portions 211 such that light will be passed between the portions of the hand gripping the brush 200'. In another embodiment, the widow 270' is located above the gripping portions 211 (see FIG. 23). In yet another embodiment, the window 270' can be located above the handle 213. In other embodiments, the window can be positioned in more than one of the locations described above.

Another factor in the location of the window 270 is the placement of the components within the internal chamber 230. Depending on such considerations as motor size, battery size or number of batteries, the space within the internal chamber 230 can limited. Thus, in some embodiments, the illumination element 260 and the PCB 240 can be located between the motor and the power source, as in FIG. 21-22, though other embodiments may require a more compact configuration.

Figure 24:
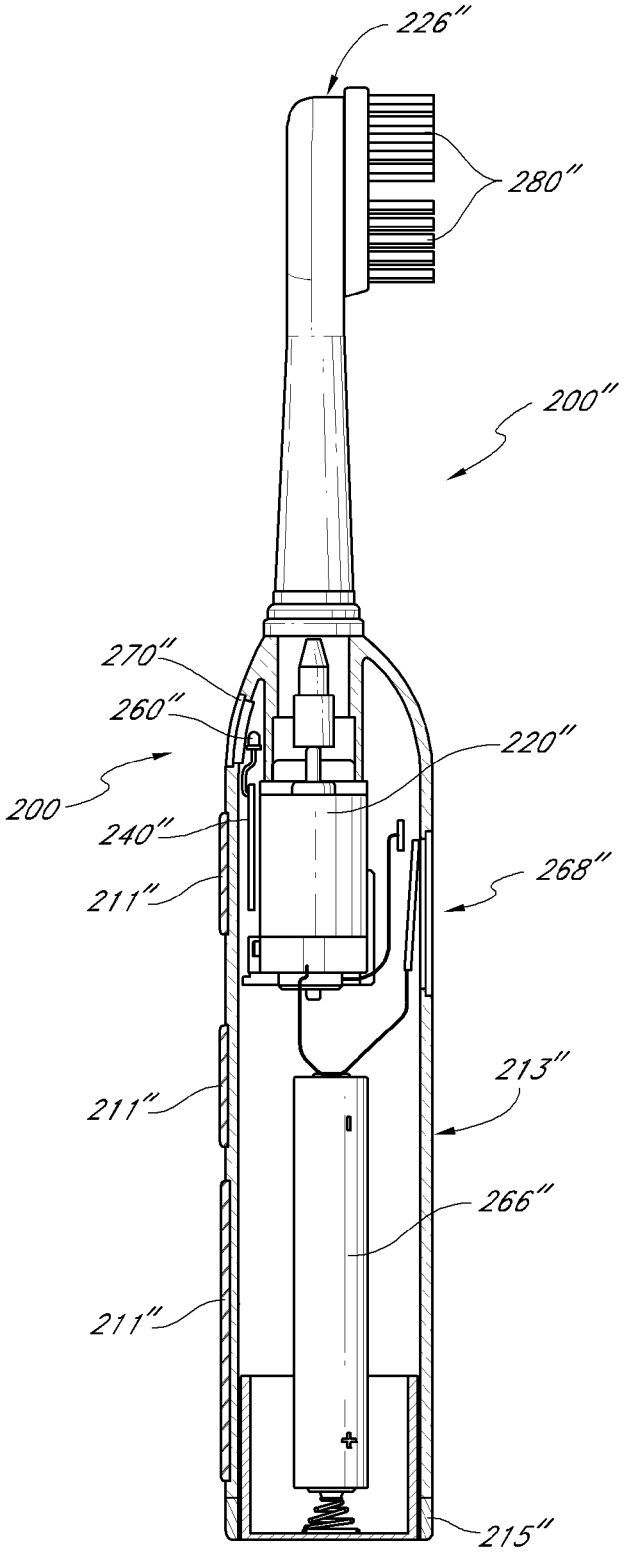
FIG. 24 illustrates a schematic embodiment of an electric toothbrush, with the toothbrush partially disassembled and partially in cross-section.

FIG. 24 illustrates another embodiment of an electric toothbrush 200". Here, the window 270" is located near the top of the handle 213". A user using the toothbrush 200" would be able to grip the toothbrush along the handle 213" such as at the gripping area 211" and see the illumination element in a mirror while the user is brushing his or her teeth.

As shown, the illumination element 260" and the PCB 240" are located between the motor and the window 270". In some embodiments, the PCB 240" and/or illumination element 260" can be connected to the motor 220".

In some embodiments, the electric toothbrush can include a display having a clock, stop watch, countdown timer and/or other type of digital or analog numeric timer. The display can used in conjunction with or instead of the timing circuits described herein. The display can also be backlit or otherwise illuminated. The illumination element can provide the backlighting of the display. The display can be an electronic or mechanical display.

In some embodiments, the illumination element can create a display by projecting information onto or through the window. The projected information can comprise various different types of information including time, time transpired, a countdown, battery life, brush life, etc. In one example, the illumination element can display, illuminate or project the number of seconds left to brush. The number can be illuminated through the window to show 60, 59, 58, 57, etc. as a countdown as to how many seconds are left to brush. In some embodiments, the numbers can be projected backwards so that they can be read while looking at a mirror.

In some embodiments, the toothbrush can be configured to relate the charge of the power sources or batteries 266 with the useful life of the bristles. For example, the charge of the batteries 266 can be set for a specified time period that has been determined under typical use conditions. When the batteries 266 run out this can indicate to a user that it is also time to replace the entire brush, for a disposable brush, or the bristles/head for a non-disposable brush. In addition, an indicator, such as in the window, or in the display, can indicate to the user to change the batteries and/or the bristles or the entire brush.

Although certain embodiments, features, and examples have been described herein, it will be understood by those skilled in the art that many aspects of the methods and devices shown and described in the present disclosure may be differently combined and/or modified to form still further embodiments. For example, any one component of the infusion sets shown and described above can be used alone or with other components without departing from the spirit of the present invention. Additionally, it will be recognized that the methods described herein may be practiced in different sequences, and/or with additional devices as desired. Such alternative embodiments and/or uses of the methods and devices described above and obvious modifications and equivalents thereof are intended to be included within the scope of the present invention. Thus, it is intended that the scope of the present invention should not be limited by the particular embodiments described above, but should be determined only by a fair reading of the claims that follow.

What is claimed is:

1. An electric toothbrush comprising:

a handle having a first end, a second end and an internal chamber;

a head coupled to the first end of the handle, the head comprising a plurality of bristles;

a grip at the second end and configured for holding the electric toothbrush by a user;

a window positioned between the head and the grip and on a side of the electric toothbrush opposite the bristles;

an illumination element within the internal chamber and configured such that light from the illumination element is visible through the window;

a power source within the internal chamber;

a motor within the internal chamber and configured to impart motion to at least one of the plurality of bristles;

a timing circuit configured to activate for a set period of time, wherein the illumination element is activated during all, part of, and/or at the end of, the set period of time;

an activation device configured to activate the motor and the timing circuit; and a frame positioned within the internal chamber, wherein the motor, the illumination element and at least a part of the activation device are attached to the frame forming a subassembly thereby being configured for assembly as a singular unit prior to insertion of the frame into the internal chamber, the frame comprising:

at least one prong configured to engage a wall of the internal chamber to secure the frame in place within the internal chamber;

wherein the electric toothbrush is configured so that, when in use brushing teeth, the user can see light from the illumination element in a mirror facing the user.

2. The electric toothbrush of claim 1, wherein the motor is configured to be on during the set period of time and to be automatically turned off after the set period of time.

3. The electric toothbrush of claim 1, wherein activation device is configured to turn off the illumination element and the motor, whether or not the set period of time has been completed.

4. The electric toothbrush of claim 1, wherein the illumination member is positioned within the internal chamber between the motor and the window.

5. The electric toothbrush of claim 1, further comprising a printed circuit board (PCB), wherein the illumination element is attached to the PCB.

6. The electric toothbrush of claim 5, wherein the illumination element and the PCB are located between the power source and the motor.

7. The electric toothbrush of claim 5, wherein the illumination element and the PCB are located between the window and the motor.

8. The electric toothbrush of claim 5, wherein the PCB is attached to a side of the motor.

9. The electric toothbrush of claim 1, wherein the at least one prong comprises two prongs.

10. The electric toothbrush of claim 9, wherein the internal chamber of the handle further comprises two slots, each configured to receive one of the two prongs.

11. The electric toothbrush of claim 1, wherein the illumination element is configured to blink during the set period of time.

12. The electric toothbrush of claim 1, wherein the illumination element is configured to blink at the end of the set period of time.

13. The electric toothbrush of claim 1, wherein the illumination element comprises a light emitting diode or an incandescent light bulb.

14. The electric toothbrush of claim 1, further comprising at least one of a clock, a countdown timer, or a stopwatch.

15. The electric toothbrush of claim 14, wherein the at least one of the clock, the countdown timer, or the stopwatch is backlit.

16. The electric toothbrush of claim 1, wherein the window comprises a lithophane-like window.

17. The electric toothbrush of claim 1, wherein the internal chamber of the handle further comprises at least one slot to receive the at least one prong.

* * * * *